United States Patent [19]

Marcone

[11] Patent Number: 4,867,076

[45] Date of Patent: Sep. 19, 1989

[54] DOG-TRACKING SCENT DISPENSING SYSTEM FOR APPREHENDING BURGLARS AND THE LIKE

[76] Inventor: Louis J. Marcone, 3865 Culver Rd., Rochester, N.Y. 14622

[21] Appl. No.: 243,701

[22] Filed: Sep. 13, 1988

[51] Int. Cl.[4] ..... E05G 5/00

[52] U.S. Cl. ..... 109/20; 109/29

[58] Field of Search ..... 109/2, 20, 25, 29; 119/29, 29.5

[56] References Cited

U.S. PATENT DOCUMENTS

| | | | |
|---|---|---|---|
| 1,477,701 | 12/1923 | Green | 109/20 |
| 2,011,120 | 8/1935 | Searle | 109/20 |
| 2,072,941 | 3/1937 | Burch | 109/20 |
| 3,230,912 | 1/1966 | Holmann | 109/20 |
| 3,956,997 | 5/1976 | Hall | 109/20 |
| 4,068,780 | 1/1978 | Fegley | 109/20 |
| 4,480,177 | 10/1984 | Allen | 109/29 |

*Primary Examiner*—Robert L. Wolfe

*Attorney, Agent, or Firm*—Mason, Fenwick & Lawrence

[57] ABSTRACT

A theft deterrent system for discharging a dog-tracking liquid chemical scent composition in spray form on a target person engaged in attempted robbery, illegal entry or manipulation or the like, at a protected location to enable trained dog trailing or identification and apprehension of such person, including a housing enclosing a pressurized spray discharge container for a supply of the liquid composition to discharge contents of the container in spray form directed toward a zone which such person would occupy or pass through to deposit droplets of the composition on the person's clothing. An actuator arm moved by a solenoid under control of a relay is provided to operate the spray head of the spray container to cause spray discharge therefrom. The apparatus may be activated by an attendant-operated switch when associated with a bank teller or money changing station, or by an intruder operated sensor or switch when associated with a window or secured passageway or by other unauthorized activity.

20 Claims, 2 Drawing Sheets

DOG-TRACKING SCENT DISPENSING SYSTEM FOR APPREHENDING BURGLARS AND THE LIKE

BACKGROUND AND OBJECTS OF THE PRESENT INVENTION

The present invention relates in general to a security system and the apparatus for dispensing a spray discharge of a dog-tracking chemical scent composition on a person engaged in an attempted robbery at a bank or the like or attempted surreptitious entry into a protected facility, wherein the chemical scent material enables the trained police dog to identify and/or follow the suspect, and more particularly to a system involving a pressurized container for discharging a non-toxic, clear, odorless, dog-tracking chemical scent material onto a person engaged in attempted robbery, such as a bank holdup, or a person surreptitiously entering a home, wherein the chemical scent composition is sprayed in mist form upon the person and will enable police dog identification and tracking of the person.

Heretofore, various types of bank protective systems have been proposed for spraying some kind of identifying composition on an attempting bank robber or the like to facilitate identification of the person or discourage the person from proceeding with the robbery. For example, U.S. Pat. No. 3,230,912 to Hohmann discloses a bank protective system wherein a discharge nozzle is provided below the counter of a teller's window for spraying a dye solution of a conspicuous color onto the body of the bank robber, and wherein jet nozzles around the teller's window are provided to spray some chemical agent such as ether or tear gar onto the face and upper body portion of the bank robber.

The Searle U.S. Pat. No. 2,011,120 discloses a protective device wherein a spray nozzle is located immediately below the bank teller counter to be operated by a foot pedal for spraying some kind of chemical solution such as paint or noxious gas onto the bank robber. U.S. Pat. No. 2,072,941 to Burch also discloses a protective device to be associated with a bank teller's window, wherein jet nozzles are provided immediately below the counter of the teller's window to spray an irritant gas, such as tear gas or similar incapacitating gas, onto the bank robber. U.S. Pat. No. 1,477,701 to Green also discloses a spray nozzle for association with a bank teller's window for spraying a temporarily blinding spray onto the bank robber.

Also, U.S. Pat. No. 3,956,997 to Hall discloses a drive-in bank teller window protection apparatus wherein a plurality of downwardly directed nozzles housed in a roof structure beneath which automobiles pass to receive service at the drive-in teller's windows discharges a quantity of viscous, adhesive and substantially opaque liquid chemical agent from downwardly directed nozzles onto the front and rear windshields and side windows of a hold-up vehicle upon actuation of a remotely controlled valve by the bank teller.

An object of the present invention is the provision of a novel system and apparatus designed to spray a chemical scent composition which is readily detectable by trained police dogs, upon the body or clothing of a person in process of a bank hold-up or attempted entry through a protected passage-way, such as a door or window into a protected dwelling or security area, enabling the trained police dog to follow the suspect from the scene of the crime or unlawful entry and facilitate apprehension of the suspect on whom the mist-like scent material is sprayed. The spray discharge device may be automatically operated or operated from a remote control switch device, and can be placed at any location where theft or surreptitious entry may be anticipated, enabling safe guarding of doors, windows, desks, file cabinets, safes and the like, as well as teller windows in banks and other money changing window-like locations. The material sprayed on the bank robber, suspect or person engaged in suspicious entry, is a non-toxic clear, odorless and harmless liquid spray material which can be readily detected by trained police dogs who can then trail the bank robber or suspect by sensing the tracking fluid odor.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 4 is a diagrammatic view of an application of the present invention to a window or doorway of a home or the like;

DETAILED DESCRIPTION OF PREFERRED EMBODIMENTS

Figure 1:
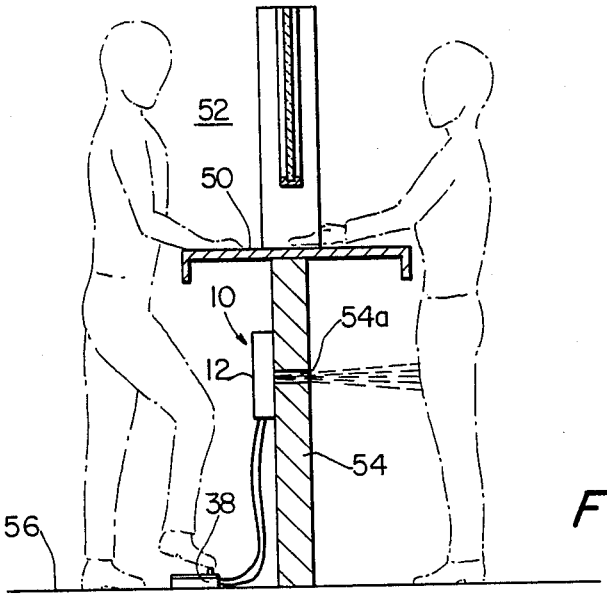
FIG. 1 is a somewhat diagrammatic fragmentary section view of a bank teller window or similar money handling station in a business establishment or the like showing the spray discharge apparatus for a dog-tracking chemical scent composition, embodying the present invention, in a typical application thereof.
Figure 2:
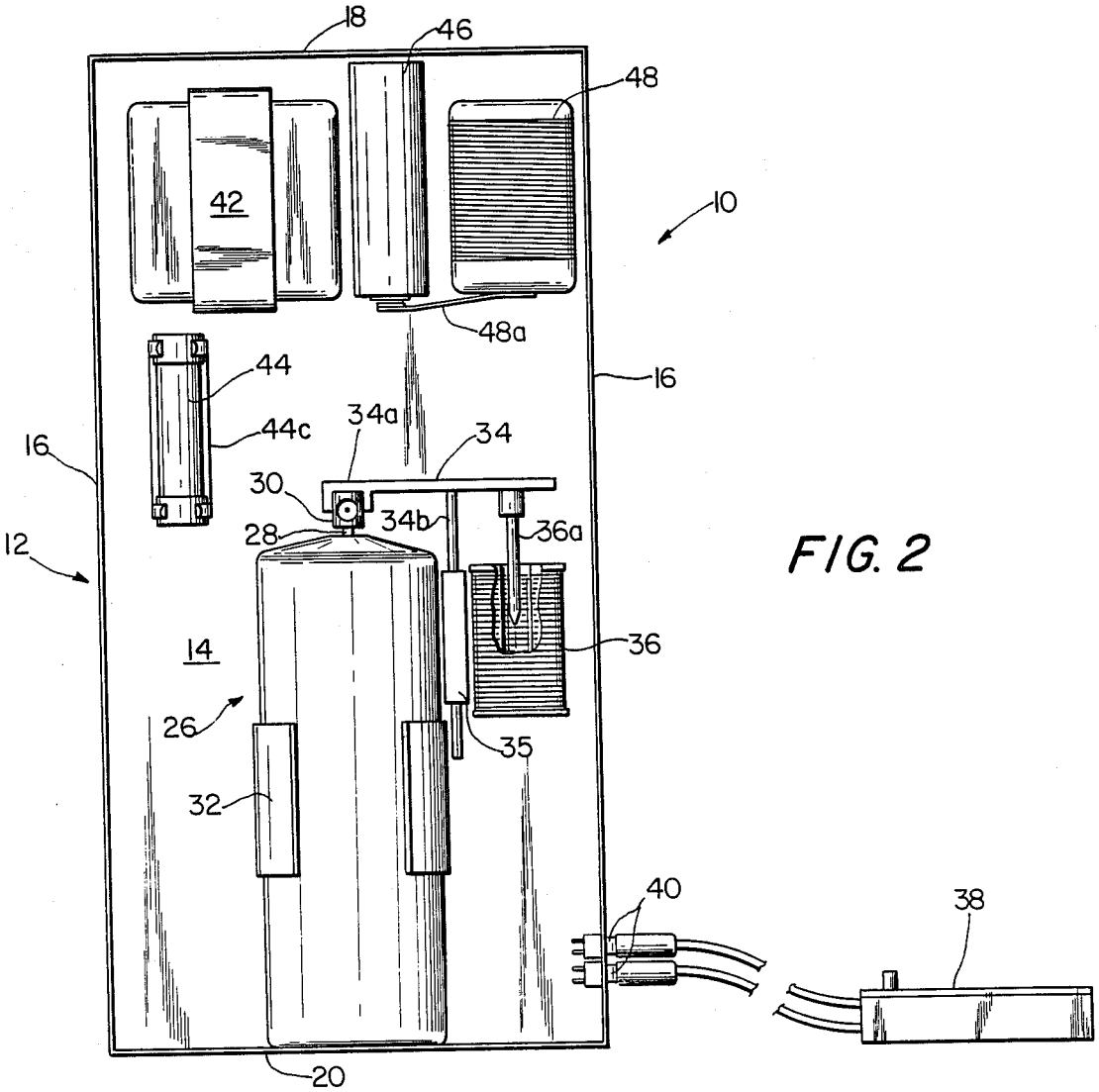
FIG. 2 is a front elevational view of the dog-tracking scent composition spray discharge apparatus of the present invention, showing the mechanical and electrical components arranged in a housing for installation at the bank teller window or the like or in association with other similar security application.
Figure 3:
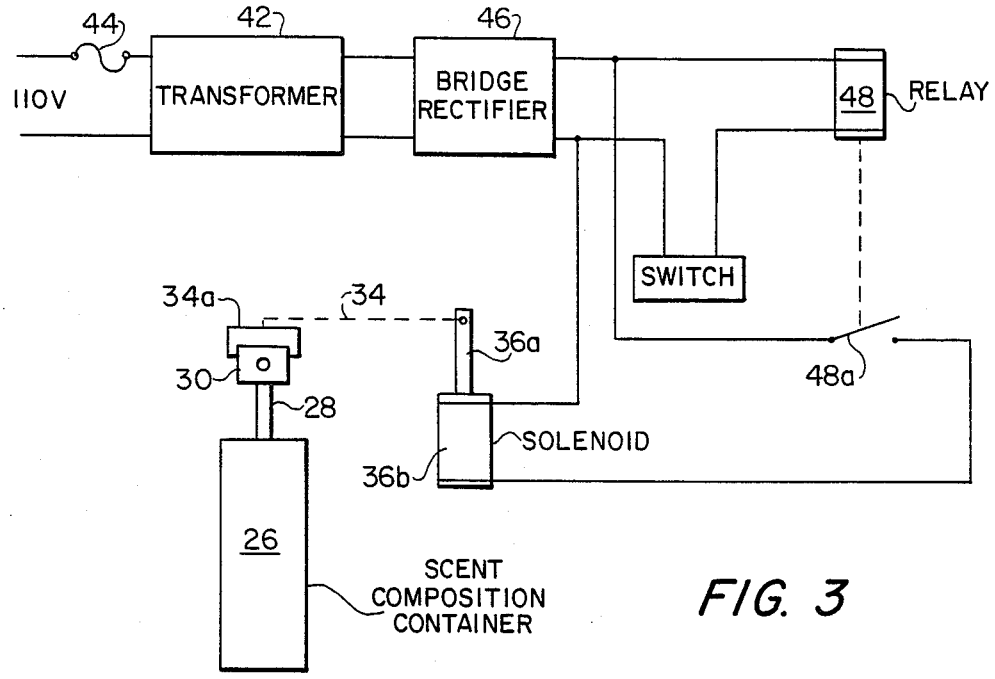
FIG. 3 is a block diagram of the electrical system for a bank teller window application of the present invention.

Referring to the drawings, wherein like reference characters designate corresponding parts throughout the several FIGS., the system of the present invention involves a spray discharge device, generally indicated by the reference character 10, arranged to be disposed beneath the counter or sill portion of a bank teller's window or other money handling establishment or adjacent a window or door of a business or private building or dwelling, or adjacent an access or entry opening to a security area or the like, arranged in a convenient housing 12 which in the preferred embodiments herein described is of generally rectangular configuration. The housing 12 may simply comprise a generally box-like housing or case having a back wall 14, a pair of side walls 16, top wall 18 and bottom wall 20, defining a mechanism chamber which maybe covered by a removable cover.

Within the housing 12 is a generally cylindrical pressurized container or canister 24 similar to the conventional commercially available aerosol containers of well-known type, for containing the dog-tracking chemical scent composition in pressurized form. In an illustrative embodiment, the pressurized container 24, forming a spray discharge device, indicated generally at 26, includes an axially movable stem of rod-like configuration 28 protruding from one end and having a spray head 30 thereon. A suitable pair of curved, concave holding members 32, such as flexible plastic or spring-like fingers, forming a clip-like canister support, are mounted on and protrude forwardly from the back wall 14 of the housing and embrace opposite curved side portions of the cylindrical side wall of the pressurized spray can or container 24 to hold it in position in the housing 12.

An actuator arm 34 is disposed immediately above and adjacent the spray head 30 of the spray discharge device 26, having a formation **34*a* at one end thereof downwardly receiving and embracing a portion of the spray head 30 and having and intermediate guide stem or bar 34*b* slidable in a guide block 35 to restrain movement of the actuator arm to rectilinear reciprocative movement in a direction parallel to the longitudinal axis of the spray can or container 24. The opposite end 34*c* of the actuator arm 34 is connected to the movable plunger 36*a* of a solenoid 36 also fixed to and carried by the back wall 14 of the housing 12**.

Power is supplied to the coil **36*b* of the solenoid 36 through a circuit including a disconnectable switch or sensor 38, connected for example to the housing 12 in an appropriate electrical circuit with the solenoid 36 and a power supply therefor by connector jacks indicated at 40 fixed in a side wall 16** of the housing.

The principal electrical circuit components of the spray discharge system incorporated in the housing 12 are a transformer 42 connected to a 110 volt power supply through a fuse 44 supported, for example, in a fuse clip **44*c* carried by the backwall 14 of the housing 12. The transformer output is connected to a conventional bridge rectifier 46 providing a DC voltage output of appropriate level to activate the coil of a relay 48 and the coil 36*b* of the solenoid 36. A moveable relay contact arm 48*a* controlled by the coil of the relay 48 which is, in turn, connected to the output of the bridge rectifier 46 through the control switch or sensor 38, is interposed in the power supply connections from the output of the bridge rectifier 46 to the coil 36*b* of the solenoid. The relay 48 is a normally opened relay, so that, when the switch or sensor 38 is activated to close the circuit between the coil of the relay 48 and the bridge rectifier 46, the contact arm 48 is moved to a closed or circuit-completing position establishing a supply circuit from the output of the bridge rectifier 46 to the coil 36*b* of the solenoid 36. This draws the solenoid plunger 36*a* downwardly and with it the actuator arm 34 is moved downwardly to depress the spray head 30 relative to the spray can or container 24 and cause spray discharge of the dog-tracking scent composition in the container from the discharge nozzle of the spray head 30**.

FIG. 1 illustrates one application of this device wherein the spray discharge unit 10 is mounted immediately below the counter 50 of a bank teller's station or window 52, by supporting the housing 12 on the lower wall portion 54 of the teller's window with the discharge nozzle of the spray head 30 aligned with an opening **54*a* and the lower wall 54 positioned so as to spray the chemical scent composition onto the clothing on the lower body portion of the bank robber or burglar. The switch 38 may be either a hand operated or a foot operated switch of conventional construction, for example placed on the floor 56 below the counter 50** at a convenient location to be foot-actuated by the teller when needed. The spray is a misted scent composition especially designed to enable trained police dogs to respond to the scent and track the suspect from the scene of the crime to apprehension. The chemical scent composition is preferably a colorless, odorless and harmless liquid material especially formulated to facilitate detection by trained police dogs. One satisfactory example of the chemical scent composition is as follows:

2 parts sharks liver oil
ten parts vegetable oil,
2 parts pylam LX5880,
2 parts pylakrom oil fluorescent,
one part butyric acid.

This formulation is put into pressurized spray containers, such as an aerosol container or the like, mixed with suitable known formulations of propellants for such a pressurized spray dispenser.

Figure 4:
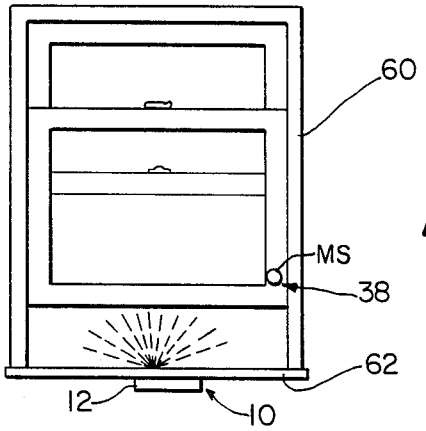
Figure 5A:
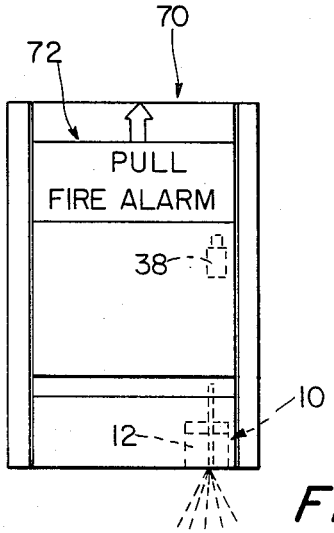
FIGS. 5*a* and 5*b* are somewhat diagrammatic front and side views of an application of the present invention to a conventional manually operated fire alarm.
Figure 5B:
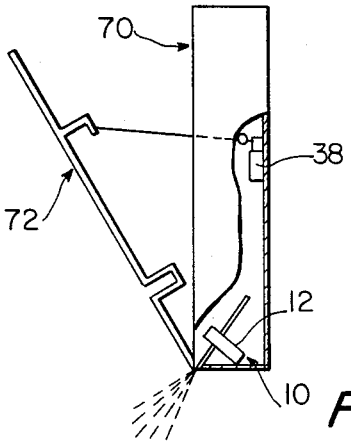

Instead of associating the scent discharge apparatus with a manned money changing station such as a bank teller's window, hotel or other money changing cashier's window, or the like, the spray discharge device maybe associated with a light or passage opening to a secured space, such as a window or door to interior space in a dwelling, to be automatically activated upon attempted entry of the window, door or the like. For example, as illustrated in FIG. 4, the apparatus maybe associated with a window 60 by supporting the spray discharge unit housing 12 below the sill 62 of the window with the discharge nozzle of the spray head 30 positioned and directed so as to spray the dog-tracking chemical scent composition onto the clothing of a person entering through the window. The spray discharge unit 10 is activated by a switch 38, which may be a mechanical switch having a contact arm normally held in a deactivating position when the window is closed, with the switch arm located so as to move, for example, under spring biasing force to an open position upon unauthorized raising of the window through a predetermined range of movement. Alternatively, a conventional commercially available magnetic switch, as indicated schematically at MS in FIG. 4, may be provided such as by having a magnet carried by a vertical frame portion of the window sash at a location near the lower right hand corner thereof, as illustrated in FIG. 4, which passes sufficiently close to a normally opened magnetically operable switch arm in a stationary switch or sensor located at a predetermined appropriate position along the window jamb to be activated by movement of the magnet along a path passing close to the magnetic sensor switch in the jamb upon raising of the sash. The switch or sensor closes the circuit to the relay 48 of the spray discharge unit to shift the relay contact arm to a circuit-closing position, activating the solenoid 36 to move the actuator arm 34 and depress the spray head 30 to cause spray discharge of the dog-tracking scent composition into the zone between the sill and the bottom edge of the window sash being opened to spray the scent composition onto the clothing of the person seeking unauthorized entry.

Another useful application of the invention involves incorporation of the spray discharge unit 10 in a fire alarm box 70, as illustrated in FIGS. **5*a* and 5*b*, wherein the switch 38 controlling the spray discharge device is mechanically coupled to the pull lever 72 of the fire alarm 70. When a person activates the fire alarm 70** by pulling on the fire alarm manual actuation lever, the switch 38 of the spray discharge unit is activated to discharge the colorless, odorless, harmless scent composition onto the lower torso of the person activating the alarm. If the alarm was determined to be a false alarm, the fire department can alert police to bring trained police dogs to the scene, whereupon the dog can track the scent from the alarm location to the person activating the false alarm.

While the present invention has been described in connection with several particular applications of the dog tracking spray scent compositions discharge apparatus, it will be apparent that the invention can be applied to many other similar applications to facilitate apprehension of burglars and other law violators by tracking of the scent with the use of trained police dogs, and it is desired, therefore, that various modifications may be made in the invention to adapt it to such applications as forwarded in the spirit and scope of the invention.

I claim:

1. A theft deterrent system for discharging a dog-tracking liquid chemical scent composition in spray form on a target person engaged in attempted robbery, illegal entry or manipulation or the like, at a protected location to enable trained dog trailing or identification and apprehension of such person, comprising a pressurized container for a supply of the liquid composition having a movable spray head member to discharge contents of the container in spray form in a selected spray pattern directed toward a zone which such person would occupy or pass through to deposit droplets of the composition on the person's clothing, electro-mechanical means for actuating the spray head member to effect spray discharge of the composition toward such zone; the electro-mechanical means including an actuator supported for movement adjacent the spray head member to activate the latter to cause spray discharge therefrom, the actuator having abutment means for engaging the spray head member to impart such movement thereto and having a coupler portion, a solenoid having a movable plunger coupled to said coupler portion to move said actuator in a manner to activate the spray head for spray discharge therefrom upon electrical energization of the solenoid, electrical circuit means for electrically spray activating said solenoid to cause spray discharge generating movement of said actuator responsive to an actuating signal, and control means coupled to said electrical circuit means to electrically activated said solenoid.

2. A theft deterrent system as defined in claim 1, wherein said control means is an person-operated switch at a predetermined location spaced from and electrically connected to said electro-mechanical means and associated pressurized container for activating means coupled to said solenoid to electrically energize the solenoid to retract said plunger and effect spray discharging of said actuator.

3. A theft deterrent system as defined in claim 1, wherein said pressurized container, electro-mechanical means actuator, and solenoid and associated electrical circuit means are supported in a box-like housing having an opening aligned with a spray discharge opening of said spray head member for passage of a spray discharge of the dog-tracking chemical scent material therethrough and along a pattern of spray discharge paths projecting therefrom to a target zone, the housing being mounted below and adjacent a bank teller's window to deposit the scent composition on clothing of a person standing in front of the window upon activation of said switch means by an attendant.

4. A theft deterrent system as defined in claim 2, wherein said pressurized container, electro-mechanical means actuator, and solenoid and associated electrical circuit means are supported in a box-like housing having an opening alined with a spray discharge opening of said spray head member for passage of a spray discharge of the dog-tracking chemical scent material therethrough and along a pattern of spray discharge paths projecting therefrom to a target zone, the housing being mounted below and adjacent a bank teller's window to deposit the scent composition on clothing of a person standing in front of the window upon activation of said switch means by an attendant.

5. A theft deterrent system as defined in claim 1, wherein said pressurized container, electro-mechanical means actuator, and solenoid and associated electrical circuit means are supported in a box-like housing having an opening aligned with a spray discharge opening of said spray head member for passage of a spray discharge of the dog-tracking chemical scent material therethrough and along a pattern of spray discharge paths projecting therefrom to a target zone, the housing being mounted below and adjacent a money changing or receiving counter to deposit the scent composition on clothing of a person standing in front of the counter upon activation by an attendant.

6. A theft deterrent system as defined in claim 2, wherein said pressurized container, electro-mechanical means actuator, and solenoid and associated electrical circuit means are supported in a box-like housing having an opening alined with a spray discharge opening of said spray head member for passage of a spray discharge of the dog-tracking chemical scent material therethrough and along a pattern of spray discharge paths projecting therefrom to a target zone, the housing being mounted below and adjacent a money changing or receiving counter to deposit the scent composition on clothing of a person standing in front of the counter upon activation of said switch means by an attendant.

7. A security system as defined in claim 1 wherein said pressurized container and electro-mechanical means are mounted below and adjacent a window sill oriented to discharge a spray of said scent composition toward a predetermined region adjacent the widow to be intercepted by a body portion of a person opening the window, and trip means carried by movable portions of the window for activating said signal producing means to actuate said solenoid upon a predetermined amount of opening movement of the widow.

8. A security system as defined in claim 3, wherein said housing with said pressurized container and associated components therein are mounted below and adjacent a window sill oriented to discharge a spray of said scent composition toward a predetermined region adjacent the widow to be intercepted by a body portion of a person opening the window, and trip means carried by movable portions of the window for activating said signal producing means to actuate said solenoid upon a predetermined amount of opening movement of the widow.

9. A security system as defined in claim 4 wherein said housing with said pressurized container and associated components therein are mounted below and adjacent a window sill oriented to discharge a spray of said scent composition toward a predetermined region adjacent the widow to be intercepted by a body portion of a person opening the window, and trip means carried by movable portions of the window for activating said signal producing means to actuate said solenoid upon a predetermined amount of opening movement of the widow.

10. A theft deterrent system as defined in claim 1 wherein said pressurized container and electro-mechanical means are incorporated in a fire alarm device having a pull handle coupled to the electro-mechanical means to activate the same to cause a spray discharge of contents of the container in a direction to deposit spray onto clothing of a person operating the fire alarm.

11. A theft deterrent system as defined in claim 2 wherein said pessurized container and electro-mechanical means are incorporated in a fire alarm device having a pull handle coupled to the electro-mechanical means to activate the same to cause a spray discharge of contents of the container in a direction to deposit spray onto clothing of a person operating the fire alarm.

12. A theft deterrent system as defined in claim 3, wherein said actuator is a rigid actuator arm having said abutment means adjacent one end thereof and said coupler portion adjacent an opposite end thereof and having a guide rod extending substantially perpendicularly from an intermediate portion of the arm, and said housing including guide block means having a recess slidably receiving said guide rod to accommodate axial movement thereof and guide the actuator arm for rectangular translation toward and away from the container in a direction paralleling the axis of the solenoid plunger.

13. A theft deterrent system as defined in claim 5, wherein said actuator is a rigid actuator arm having said abutment means adjacent one end thereof and said coupler portion adjacent an opposite end thereof and having a guide rod extending substantially perpendicularly from an intermediate portion of the arm, and said housing including guide block means having a recess slidably receiving said guide rod to accommodate axial movement thereof and guide the actuator arm of rectangular translation toward and away from the container in a direction paralleling the axis of the solenoid plunger.

14. A theft deterrent system as defined in claim 12, wherein said housing includes a relay having a coil connected to an electrical supply through said control means for energizing the relay upon activation of the control means, the relay including a normally open contact connected to said supply and to said solenoid to energize the solenoid upon closure of the relay contact responsive to electrical energy supply to the relay coil.

15. A theft deterrent system as defined in claim 13, wherein said housing includes a relay having a coil connected to an electrical supply through said control means for energizing the relay upon activation of the control means, the relay including a normally open contact connected to said supply and to said solenoid to energize the solenoid upon closure of the relay contact responsive to electrical energy supply to the relay coil.

16. A theft deterrent system as defined in claim 1, wherein said dog-tracking chemical scent composition in said pressurized container includes a mixture of shark's liver oil and a vegetable oil.

17. A theft deterrent system as defined in claim 4, wherein said dog-tracking chemical scent composition in said pressurized container includes a mixture of shark's liver oil and a vegetable oil.

18. A theft deterrent system as defined in claim 6, wherein said dog-tracking chemical scent composition in said pressurized container includes a mixture of shark's liver oil and a vegetable oil.

19. A theft deterrent system as defined in claim 16 wherein said composition additionally incldues butyric acid and a fluorescent oil.

20. A theft deterrent system as defined in claim 19 wherein said composition additionally includes butyric acid and a fluorescent oil.

* * * * *